United States Patent [19]

Sabongi et al.

[11] Patent Number: 4,548,896

[45] Date of Patent: Oct. 22, 1985

[54] DYE-BLEACH MATERIALS AND PROCESS

[75] Inventors: Gebran J. Sabongi, Woodbury, Minn.; Stephen S. C. Poon, Harlow, England

[73] Assignee: Minnesota Mining and Manufacturing Company, St. Paul, Minn.

[21] Appl. No.: 586,770

[22] Filed: Mar. 6, 1984

[30] Foreign Application Priority Data

Mar. 15, 1983 [GB] United Kingdom ..... 8307021

[51] Int. Cl.[4] ..... G03C 5/24

[52] U.S. Cl. ..... 430/332; 430/348; 430/350; 430/517; 430/522; 430/339

[58] Field of Search ..... 430/339, 920, 348, 350, 430/517, 522, 332

[56] References Cited

U.S. PATENT DOCUMENTS

| | | | |
|---|---|---|---|
| 3,595,655 | 7/1971 | Robinson et al. | 430/339 |
| 3,595,658 | 7/1971 | Gerlach et al. | 430/339 |
| 3,627,527 | 12/1971 | Gilman et al. | 96/1.6 |

OTHER PUBLICATIONS

Chao-Tung Chen, et al.—Dyes Derived from Furfural, Aniline, and Organic Acids—pp. 49-60.

Elliot N. Marvell, et al.—Formation of Phenylpyridinium Chloride from 5-Anilino-N-Phenyl-2,-4-Pentadienylideniminium Chloride, Kinetics in Basic Media, pp. 5641-5649.

Elliot N. Marvell,—Mechanism of the Formation of Phenylpyridinium Chloride from 1,7-Diphenyl-1,-7-Diazahepta-1,3,5-Triene—pp. 277-280, Tetrahedron Letters, No. 3, Pergamon Press Ltd.

Elliot N. Marvell, et al.—Formation of Phenylpyridinium Chloride from 5-5-Anilino-N-Phenyl-2,-4-Pentadienylideniminium Chloride in Acidic Media, pp. 2089-2092, Tetrahedron Letters, No. 23, Pergamon Press.

K. G. Lewis et al.—Aspects of the Formation and Use of Stenhouse Salts and Related Compounds, pp. 463-475, Tetrahedron Report No. 26, Pergamon Press.

Journal of American Chemical Society, vol. 72, May 1950.

J. C. McGowan—The Preparation of Bases from the Colored Compounds formed by Condensation of Furfuraldehyde with Aromatic Amines, pp. 777-779, (1949).

*Primary Examiner*—Won H. Louie

*Attorney, Agent, or Firm*—Donald M. Sell; James A. Smith; Mark A. Litman

[57] ABSTRACT

An imagewise bleachable composition is described comprising a dye in reactive association with a mesoionic compound. The composition may be bleached by radiation at wavelengths between 200 and 1000 nm.

25 Claims, No Drawings

DYE-BLEACH MATERIALS AND PROCESS

This invention relates to compositions containing a bleachable dye which may be bleached upon exposure to radiation of selected wavelength within the general range 200 to 1100 nm, and/or upon heating. In particular, the invention relates to compositions containing a bleachable dye in reactive association with a mesoionic compound, e.g. a sydnone, and the use of such compositions as a photo- and/or heat-sensitive layer in an image recording element, as an antihalation layer and as a liquid actinometer.

Radiation dye-bleach systems are known and are well documented in the literature and include systems sensitive to light and systems sensitive to heat. One type of photosensitive system employs silver halide in which the reduction of a silver halide latent image to a silver image is used to catalyse the bleaching of the dye, thus giving rise to a silver-free dye image. Examples of such processes are disclosed in *The Theory of the Photographic Process,* T. J. James, 4th Edition, (1977), The MacMillan Publishing Company Inc., New York, Chapter 12, page 373, British Patent Specification No. 1 560 014 and U.S. Pat. No. 4,202,698. Other photosensitive systems are silverless and utilize the photochemical properties of photochromic compounds which change from coloured to colourless species upon exposure to light. Examples of silverless systems are disclosed in British Patent Specification Nos. 1 166 240, 1 370 058 to 1 370 060, U.S. Pat. No. 4,307,182 and European Patent Specification No. 0040978.

Examples of heat-sensitive dye-bleach systems include processes utilising hexa-amine cobalt (III) complexes and a pyrylium dye as disclosed in Res. Descl. Sept. 1980, p. 366, and the thermochromic compounds disclosed in British Patent Specification No. 1 356 840. U.S. Pat. No. 3,852,093 discloses thermo-imaging systems using p-quinone-imine dyes and a mild reducing agent, and U.S. Pat. Nos. 3,609,360 and 3,684,552 disclose acid release and base release processes respectively as a basis for thermographic imaging.

Many of the known dye-bleach imaging processes suffer from one or more disadvantages, e.g. they are limited to either heat or light sensitivity, they require separate processing steps, e.g. silver bleaching, or they are limited to a few specific useful dye structures. They may also be undesirably prone to reversibility of bleaching, e.g. by aerial oxidation. There may also be the need for many ingredients in the formulation and many known formulations are not readily coated by both solvent and aqueous means. Furthermore, few of the known processes function in any state other than a coated layer, e.g. a thin film solution.

The present invention provides a dye bleach system sensitive to heat and/or light, in which the above disadvantages are at least substantially reduced.

Therefore according to the present invention there is provided a composition capable of bleaching upon exposure to radiation of selected wavelength within the range 200 to 1100 nm and/or upon heating to at least 70° C., the composition comprising a bleachable dye (as defined herein) in reactive association with a mesoionic compound.

The compositions of the invention may be any desired colour upon suitable selection of one or more dyes and are capable of bleaching under the effect of light, particularly ultra violet light, and/or heating to a minimum temperature of 70° C., preferably 80° C., depending upon the mesoionic compound present. The liquid compositions may be used as an actinometer and the solid formulations find utility in light or heat sensitive imaging systems for recording a positive image and for use as antihalation layers or coatings.

The term "bleachable dye" used herein refers to a dye which is capable of bleaching in the presence of a mesoionic compound upon exposure to radiation of selected wavelength within the range 200 to 1100 nm corresponding to the longest wavelength absorption peak of the mesoionic compound and/or upon heating to at least 70° C., the dye having a structure comprising a conjugate chain with alternating double and single bonds, equal numbers of each, joining two polar atoms which are capable of existing in two adjacent states of covalency. Most useful dyes are polymethine dyes, this term referring to dyes having at least one electron donor and one electron acceptor group linked by methine groups or aza analogues. Dyes of this general class are well known and documented in the literature relating to the photographic art, e.g. *The Theory of the Photographic Process,* referred to above.

In practice, a bleachable dye will be capable of undergoing a change such that the transmissive optical density will drop from 1.0 to less than 0.09, preferably less than 0.05.

Within the above general class of dyes are three species of dye of particular significance. These species are dyes which include within their structure one of the following systems:

(1)

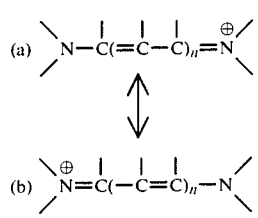

Amidinium-ion system (2)

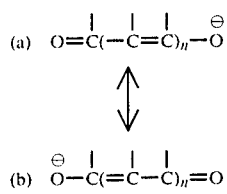

Carboxyl-ion system (3)

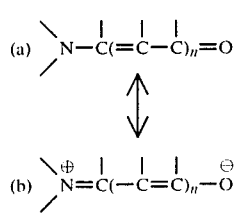

Amidic system

It will be appreciated that the two structures (a) and (b) for each system differ only in the way the electrons are disposed, not in the location of atoms. One or more carbon atoms in the chains may be replaced by nitrogen providing the conjugated structure is not disrupted. In actual dye examples the valencies shown unsatisfied in the skeletal formulae are completed as will be described and illustrated hereinafter.

In general, bleachable dyes for use in the invention will be of the general formula:

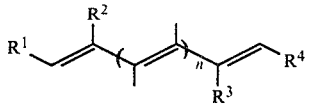

in which:

n is an integer of 1 to 5, $R^1$ to $R^4$ are selected to provide an electron donor moiety at one end of the conjugated chain and an electron acceptor moiety at the other, and represent alkyl, aryl groups or heterocyclic rings any of which may be substituted, said group generally containing up to 14 atoms selected from C, N, O and S; or $R^1$ and $R^2$ and/or $R^3$ and $R^4$ may represent the necessary atoms to complete optionally substituted aryl groups or heterocyclic rings, generally containing up to 14 atoms selected from C, N, O and S.

The conjugated chain is preferably composed of carbon atoms but may include one or more nitrogen providing the conjugation is not disrupted. The free valencies on the chain may be satisfied by hydrogen or any substituent of the type used in the cyanine dye art including fused ring systems.

The particular selection of substituents $R^1$ to $R^4$ effects the light absorbance properties of the dye which may be varied to provide absorption peaks ranging from the ultra violet (200 to 400 nm), near visible (400 to 500 nm), visible (500 to 700 nm) and infra red (up to 1100 nm). The absorption characteristics of the dyes do not significantly effect the sensitivity of the composition of the invention, which is governed by the particular selection of mesoionic compound.

Within the above general structure of dyes are various classes of dyes including:

(1) Cyanine dyes of the general formula:

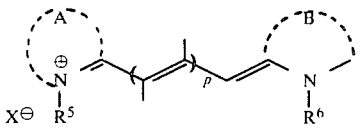

in which:

p is an integer of 0 to 5, $R^5$ and $R^6$ are independently hydrogen or substituents which may be present in conventional cyanine dyes, e.g. alkyl, etc., $X^{\ominus}$ represents an anion, and A and B independently represent alkyl, aryl or heterocyclic groups or the necessary atoms to complete heterocyclic rings which may be the same or different. The groups A and B generally contain up to 14 atoms selected from C, N, O and S.

This class of dyes is very well known particularly in the silver halide photographic art and are the subject of numerous patents. General references to these dyes include *The Chemistry of Synthetic Dyes,* K. Venkataraman ed., Academic Press, Vol. 4 (1971) and *The Theory of the Photographic Process,* T. H. James, ed., MacMillan, Editions 3 and 4.

(2) Merocyanine dyes of the general formula:

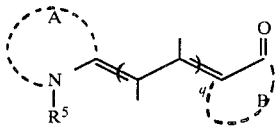

in which:

q is an integer of 0 to 5, $R^5$ and A are as defined above, and

B is as defined above or may complete a carbocyclic ring.

These dyes are also well known in the silver halide photographic art and are described in *The Theory of the Photographic Process,* referred to above.

(3) Oxonols of the general formula:

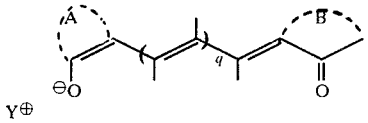

in which:

q is an integer of 0 to 5,

A and B may be the same or different and are as defined above in relation to cyanine and merocyanine dyes, and $Y^{\oplus}$ represents a cation.

Oxonol dyes are similarly well known in the silver halide photographic art and are disclosed in the above mentioned reference, *The Theory of the Photographic Process* and U.S. Pat. No. 2,611,696.

It is to be understood that these cyanine, merocyanine and oxonol dyes may bear substituents along the polymethine chain composed of C, N, H, O and S, and that these substituents may themselves join to form 5, 6 or 7 membered rings, or may bond with rings A and B to form further rings, possibly with aromatic character. Rings A and B may also be substituted by C, N, H, O and S containing groups.

Other known classes of dyes useful in the invention which possess an activated methylene chain include bisquinones, bisnaphthoquinones, hemicyanine, streptocyanine, anthraquinone, indamine, indoaniline, indophenol, polymeric nigrosin.

Examples of dyes of the above described types include:

(A) Cyanines of the formula:

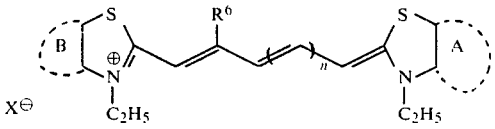

| Dye No. | $R^6$ | A and B | $X^{\ominus}$ | n | λmax nm (EtOH) |
|---|---|---|---|---|---|
| C-1 | H | Ph | $Br^{\ominus}$ | 0 | 550 |
| C-2 | $CH_3$ | Ph | $I^{\ominus}$ | 0 | 540 (FIG. 1) |
| C-3 | H | Ph | $CH_3.C_6H_4SO_3^{\ominus}$ | 1 | 650 |
| C-4 | H | Ph | $I^{\ominus}$ | 2 | 760 |
| C-5 | H | H | $I^{\ominus}$ | 0 | 449 |

(B) Oxonols of the formula:

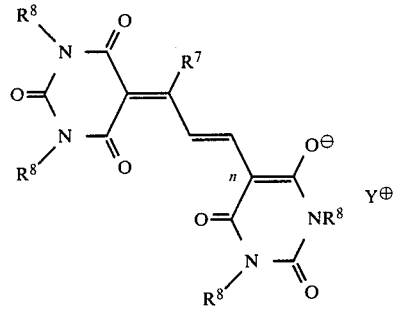

| Dye No. | $R^7$ | $R^8$ | $Y^{\oplus}$ | n | λmax nm (EtOH) |
|---|---|---|---|---|---|
| O-1 | H | $C_2H_5$ | $Et_3NH^{\oplus}$ | 0 | 450 |
| O-2 | $CH_3$ | $CH_3$ | $Et_3NH^{\oplus}$ | 0 | 460 |
| O-3 | H | $CH_3$ | $Et_3NH^{\oplus}$ | 1 | 492 |
| O-4 | H | $CH_3$ | $Et_3NH^{\oplus}$ | 2 | 590 |

Oxonols of the formula:

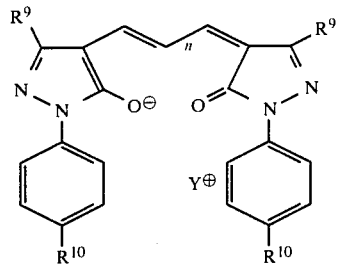

| Dye No. | $R^{10}$ | $R^9$ | n | $Y^{\oplus}$ | λ max nm (EtOH) |
|---|---|---|---|---|---|
| P-1 | $SO_3^{\ominus}$ | $CH_3$ | 1 | $3(Et_3N^{\oplus}H)$ | 520 |
| P-2 | $SO_3^{\ominus}$ | COOEt | 1 | $3(Et_3N^{\oplus}H)$ | 553 |
| P-3 | H | $CH_3$ | 1 | 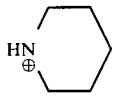 | 524 |
| P-4 | $SO_3^{\ominus}K^{\oplus}$ | $CH_3$ | 2 | $Et_3N^{\oplus}H$ | 620 |

(C) Quinones of the formula:

| Dye No. | | | |
|---|---|---|---|
| Q-1 | 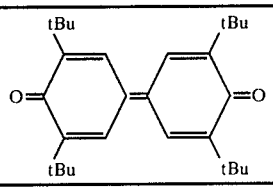 | | λmax 430 nm ($CHCl_3$) tBu = t-butyl |

(D) Polymeric nigrosin of the formula:

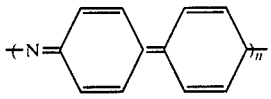

(E) Merocyanines of the formula:

| Dye No. | | |
|---|---|---|
| M-1 | 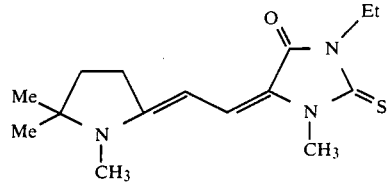 | λmax 471 nm ($CHCl_3$) |
| | 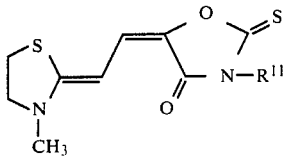 | |

| Dye No. | $R^{11}$ | λmax ($CHCl_3$) in nm |
|---|---|---|
| M-2 | $-CH_3$ | 454 |
| M-3 | $-C_2H_5$ | 459 |
| M-4 | $-CH_2CH_2OH$ | 455 |

The bleaching agent used in combination with the bleachable dye is a member of the class of mesoionic organic compounds. A compound is mesoionic if it contains a five- or possibly six-membered heterocycle which cannot be represented satisfactorily by any one covalent or polar structure and possesses a sextet of electrons in association with all the atoms comprising the ring. Such compounds are known and are disclosed, for example, in Baker et al, Quart. Rev. Chem. Soc. (1957) 11, 15, Baker et al, J. Chem. Soc. 307 (1949), Kirk Orthmer Encyclopaedia of Chemical Technology, 2nd Edition, 10, 918 to 9210 (1966) John Wiley & Sons Inc., and *The Principles of Heterocyclic Chemistry,* A. R. Katritzky and J. M. Lagowski, 136 to 139, 1967, Metheun & Co. Ltd.

Mesoionic compounds are known to undergo reactions with activated multiple bonds, e.g. 1,3-dipoles undergo thermally or photochemically initiated 1,3-dipolar cycloaddition reactions with activated double bonds as described in R. Huisgen, Angew. Chem. Int. Ed., Engl., 2, 565 (1963) and R. Huisgen, Chem. Soc. Spec. Publ. 21, 51 (1907).

Sydnones are known to react with activated multiple bonds as described in R. Huisgen et al., Chem. Ber., 101, 536 (1968) and R. Huisgen et al., Chem. Ber., 101, 522 (1968).

The invention utilises the ability of mesoionic compounds to react with activated double bonds and the composition of the invention is bleached by thermal or photolytic excitation of the mesoionic compound which adds on the conjugated chain of the dye to form a colourless species. Thus, any mesoionic compound compatible with the desired formulation of binder and/or solvent may be used in the invention. The particular selection of mesoionic compound will determine the light sensitivity of the composition since this property is dependent upon the absorbance maximum of the sydnone rather than the dye.

Preferred mesoionic compounds contain a five-membered ring, containing carbon and at least one of N, O and S. This ring is substituted preferably by oxygen (or sulphur). Such compounds have found application as pharmaceuticals, organic synthesis, as cross-linking agents for polymers, as photochromics and as latent image stabilisers in silver halide photography. A preferred class within this group are the 1,2,3-oxadiazolium-5-olates known as sydnones.

Sydnones can be generally described by the structure:

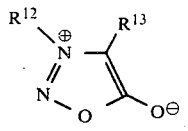

in which:

$R^{12}$ represents an alkyl or aryl group or a heterocyclic ring, any of which groups may be substituted and preferably represents an aryl or heterocyclic ring and more preferably substituted aryl or substituted heterocyclic ring, and $R^{13}$ represents an alkyl or aryl group either of which may be substituted, a hydrogen atom, an amino or an alkoxy group, preferably $R^{13}$ represents a hydrogen atom.

The groups $R^{12}$ and $R^{13}$ generally contain up to 14 atoms selected from C, N, O and S.

Binuclear sydnones include those of the structure:

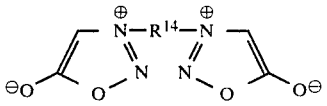

in which:

$R^{14}$ represents a divalent bridging group, e.g. aliphatic or cyclic groups having a skeletal structure composed of one or more carbon atoms optionally in combination with O, N and/or S atoms, e.g. alkylene, arylene or substituted derivatives of these groups, or $—SO_2—$.

Substituents on $R^{12}$, $R^{13}$ or $R^{14}$ may vary in nature between hydrogen, electron donating or electron withdrawing groups or a combination of the above such as halogen, etc.

Examples of known sydnones include:

3-methylsydnone
3-pentylsydnone
3-dodecylsydnone
3-(3',4'-dichlorophenyl)sydnone
3-thionylsydnone
3-furfurylsydnone
3-naphthylsydnone
3-phenyl-4-methylsydnone
3,4-diphenylsydnone
3,4-diethylsydnone
3-(4'-(3''-sydnone)phenyl)sydnone.

Examples of sydnones which were employed in the experimental data hereinafter include:

S-1 3-(3'-pyridyl)sydnone and those of the formula:

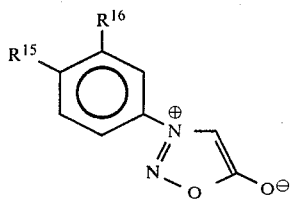

| No. | sydnone | $R^{15}$ | $R^{16}$ |
|---|---|---|---|
| S-2 | 3-phenylsydnone | H | H |
| S-3 | 3-(4'chlorophenyl)sydnone | Cl | H |
| S-4 | 3-(3',4'-dichlorophenyl)sydnone | Cl | Cl |
| S-5 | 3-(4'-fluorophenyl)sydnone | F | H |
| S-6 | 3-(4'-bromophenyl)sydnone | Br | H |
| S-7 | 3-(4'-methoxyphenyl)sydnone | $OCH_3$ | H |
| S-8 | 3-(4'-cyanophenyl)sydnone | CN | H |
| S-9 | 3-(4'-hydroxyphenyl)sydnone | OH | H |

The liquid compositions of the invention are readily prepared by dissolving the dye and mesoionic compound in a solvent. Suitable solvents include water and organic polar or non-polar solvents, e.g. alcohols, ketones and hydrocarbons. The dye is generally dissolved in an amount to provide a transmission optical density in the range 0.5 to 1.6, preferably about 1.0, and the mesoionic compound is generally present in a weight ratio of at least 4:1 with respect to the dye. The liquid compositions may serve as an actinometer detecting the presence of heat and/or radiation of a particular wavelength band which causes bleaching of the coloured solution. The actinometer may be incorporated in a device which is triggered by the colour change.

Preferably the compositions of the invention are solid and take the form of a self-supporting film or one or more layers coated on a suitable support to provide a direct image forming medium.

A recording element may be made with a single mesoionic compound in association with one dye, which will normally give a pure colour. Use of more than one dye with a single mesoionic compound may give a variety of colours. Use of three dyes with one mesoionic compound may give a black which may be bleached. Alternatively, more than one mesoionic compound may be present in the layer.

Use of mesoionic compounds in separate layers each associated with a substantially different coloured dye will, if there is sufficient spectral separation of the absorption peaks of the mesoionic compounds, allow the bleaching of specific layers provided the exposing sources have spectral characteristics to match the appropriate mesoionic compounds.

The dye and mesoionic compound are incorporated in a binder medium which is normally coated on a base. The binders may be organic solvent- or water-soluble polymers, for example, polystyrene, styrene-acrylonitrile or styrene-acrylate copolymer, polyvinylchloride, vinyl chloride-vinyl acetate copolymers, vinylidine chloride-vinyl acetate copolymers, polyacrylates, polyvinylbutyral, cellulose acetate, ethyl cellulose, polyvinyl alcohol, methyl cellulose, polyvinyl pyrrolidone, gelatin and derivatives of gelatin. The binder, dye and mesoionic compound are preferably coated as a solution in a suitable solvent. Alternatively, dispersions may be made in suitable polymeric emulsions.

A particular selection of binder composition may have a significant effect upon the sensitivity of the composition. In practical applications for imaging purposes, it is often desirable for the composition to be bleachable within a period of three minutes, more preferably one minute. It has been found that in order for reactive association between the dye and mesoionic compound to be sufficient for bleaching within a relatively short exposure or heating time, it is necessary to provide a "soft" medium which will allow the ready attainment of reactive association. Most preferred polymeric binders which provide this property can be defined as non-rigid, where the polymeric chains are not bonded tightly together by Van der Waals' forces or the like. Such forces can be overcome by an increase in the kinetic energy of the polymeric chain, for example by heating. Polymeric binders with a low melting point can overcome such attractive forces more easily at moderate temperatures. This would facilitate the reactive association of the reactants which are interlocked within them and this accelerates the chemical reaction. Most useful binders would have melting points between 40° to 200° C. (as described in "Modern Plastics Encyclopaedia" 1981-2, McGraw Hill Publishers, Vol. 58, page 514).

However, the binding medium is not limited to polymeric binders having a low melting point since the desirable "soft" properties may be attained by the presence of suitable plasticisers. The presence of a plasticiser may reduce the Van der Waals' forces between the polymeric molecular chains at temperatures lower than the melting temperatures of the polymer as described in "The Encyclopaedia of Basic Materials for Plastics", H. R. Simonds, ed., Reinhold Publishing Corp., N.Y., 1967, page 360.

In general, the plasticisers having low molecular weights favour faster bleaching reactions. Particularly suitable plasticisers include glycerol, sorbitol, polyglycols, polyethylene glycols and esters thereof, such as glyceryl mono-laurate, polyethylene glycol distearate and others.

In addition, the composition may optionally include thermal solvents (i.e. solids with low melting points) such as beeswax, acetamide, methyl anisate, 1,8-octane diol and others.

A further factor which may significantly affect the speed of the composition is the relative solubilities of the dye and mesoionic compound in the binder and plasticiser. Preferably, the dye and mesoionic compound are soluble in the binder when the reaction occurs. Thus, for light sensitive elements it is desirable that both the dye and mesoionic compound be soluble in the binder at room temperature. Heat-activated elements may comprise a fine dispersion of one or both of the dye and mesoionic compound in the binder at room temperature but preferably the dye and mesoionic compound are both solubilised at the temperature of the reaction. The composition may also take the form of an emulsion with the dye and mesoionic compound dissolved in one media and carried in a binder.

Coating formulations for the preparation of direct image forming media generally comprise:

0.01 to 1.0%, preferably 0.08 to 0.4% by weight of dye,
0.04 to 10%, preferably 3 to 4.5% by weight of mesoionic compound,
0.5 to 25%, preferably 1 to 20%, more preferably 10 to 20% by weight of binder, to 100% solvent (w/v).

Plasticiser may be present in amounts up to 10% by weight, preferably 4 to 7% by weight of the composition. Other ingredients, e.g. coating aids, surfactants, cross-linking agents for the binder may be included.

The formulation may be coated on any desired support or base by conventional techniques. The base or support material can be of any natural or synthetic product in fabric, film or sheet form, e.g. polyester film. The coating may be applied directly to the surface of the support or the support may be provided with one or more layers, e.g. subbing layer, prior to applying the compositions of the invention. A transparent, optionally coloured, non-tacky top coat for protection may be applied over the radiation sensitive layer(s).

The direct image forming elements of the invention do not require a post-exposure image developing step. Where the mesoionic compounds absorb in the ultraviolet, generally no fixing is necessary. Where the mesoionic compounds absorb in the visible region or infrared it is necessary to stabilise the exposed coating. This is achieved by removing the mesoionic compound from reactive association with the dye, e.g. by selective solubilisation, or chemical or other deactivation of the mesoionic compounds.

The dye bleach reaction can be triggered by light, e.g. ultraviolet radiation, or heat; the resulting direct image can be read by light of different wavelength depending on the coloured component absorbance, i.e. for a magenta dye, reading with white or green light, for an infrared dye reading with an infrared light source and for a UV absorbing dye a UV source of lower intensity and different wavelength than the triggering source. The materials find application in a wide range of image recording fields, e.g. for colour proofing where no development is required, for direct read-after-write material for electronic outputs, for temporary image proofing for silver halide in the graphic arts field (where zonal exposures of a silver halide layer may be made in order to make a composition print where the materials of this invention give the direct image so that registration can properly be made before the entire film is given a single development to amplify the silver), for over-head visual transparency film, and for laser imaging applications optionally including a carbon layer if infrared radiation is to be used.

The compositions of this invention may be used to make materials suitable for use on overhead transparency projectors. An optical density of 0.5 to 1.5 is preferred for the unexposed coating and a density of $<0.1$ after exposure.

Compositions of the invention have been satisfactorily passed through a Thermo-Fax processor (Minnesota Mining and Manufacturing Company) where the elements were heated by exposure to an infrared source while in intimate contact with a positive alpha-numeric image on paper. The heat created in the infrared radiation absorbing image areas, caused the coating in intimate contact to bleach and a negative of the original was obtained.

The solid compositions of the invention may also be employed as bleachable antihalation layers. Such layers may be obtained by coating formulations similar to those for the production of direct image recording media but having a smaller concentration of dye, e.g. of the order of 0.1% by weight. When required the antihalation layer may readily be bleached by uniform exposure to the radiation band to which it is sensitive, e.g. ultraviolet light, or by heating, e.g. to 80° C. Generally, transmission optical densities to white light of approximately 0.4 are desirable for antihalation purposes.

The invention will now be illustrated by the following Examples.

In the following Examples the light or heat sensitive elements bleached under the experimental conditions to reduce the transmissive optical density by at least 50% and in some cases substantially complete bleaching occurred. It will be appreciated that the exposure conditions used in the Examples are not necessarily the optimum conditions for exposure of each element and so each Example does not represent an optimised system. Tests conducted on random elements in accordance with the Examples revealed that substantially complete bleaching could be attained upon lengthening the exposure time to light or lengthening and/or increasing the temperature for thermal exposure.

EXAMPLE 1

Bleach reaction in solution

A solution of dye with, and without (for reference), 3-(3'-pyridyl)sydnone (S-1) (at 1:1 molar ratio) was prepared in ethanol and was irradiated for various periods of time using a Philips 200 Watt UV lamp of a broad emission spectrum.

The sample and the reference solution were monitored using a Perkin-Elmer spectrophotometer. The different in absorbance at the $\lambda_{max}$ of the dye before and after exposure was recorded and reflects the bleaching rate. The dyes used and the results are reported in the following Table in which δ-absorbance represents the difference in visible absorbance before and after exposure at the $\lambda_{max}$ of the dye.

| | δ-absorbance* | | |
|---|---|---|---|
| Dye | Sample | Reference | Exposure time (min) |
| C-2 | 1.25 | 0.40 | 5 |
| C-2 | 1.00 | 0.10 | 3 |
| C-3 | 1.30 | 0.15 | 2 |
| O-3 | 1.70 | 0.10 | 2 |
| O-4 | 1.55 | 0.05 | 0.5 |
| C-5 | 1.80 | 0.55 | 1 |

EXAMPLE 2

Coated formulation using 3-phenylsydnone and three dyes, a yellow, a magenta and a cyan dye of the oxonol class, under photochemical excitation Coating formula:

| | |
|---|---|
| Dye solution (0.4% w/v in ethanol) | 100 ml |
| 3-phenylsydnone (S-2) | 3 g |
| polyethylene glycol (molecular weight 1500) | 4 g |
| polyvinyl butyral (Butvar B-76, Monsanto) | 10 g |

The formulations were hand coated using a K-bar No. 6 (R.K. Chemicals Ltd.) on an unsubbed polyester base. The coating was dried at room temperature under yellow safelight.

The coatings were then exposed to UV light (metal halide lamp) through a contact photographic step wedge of 0 to 2 log E at 0.15 log E increments. The exposure time was 120 seconds at 5 kW power at 70 cm distance. The densities were measured using a transmission densitometer and plotted against log E.

The number of steps, S, bleached to give an optical density of half the difference between the initial absorbance and the residual absorbance (after the maximum amount of bleaching under the exposure conditions) is reported in the following Table. The optical density measurements were made with red light.

| Dye No. | Steps bleached S | Initial Optical Density (1) | Final Optical Density (2) |
|---|---|---|---|
| P-4 cyan | 7 | 0.57 | 0.02 |
| P-1 magenta | 6 | 0.65 | 0.05 |
| 0-2 yellow | 3 | 0.33 | 0.14 |

(1) approximately step 12.
(2) approximately step 1.

EXAMPLE 3

Coated formulation using 3-phenylsydnone and three dyes of oxonol class under thermal excitation Coating formula:

| | |
|---|---|
| Dye solution (0.4% W/V in methylethylketone:ethanol 3:2) | 100 ml |
| 3-phenylsydnone | 3 g |
| polyethylene glycol (MW 1500) | 4 g |
| vinylidene chloride-acrylonitrile copolymer (Saran F-310, Dow Chemicals) | 20 g |

The formulations were hand coated using K-bar No. 6 as in Example 2. The coating was dried at room temperature under yellow safelight. Once dry, the coating can be handled under white light.

The coating was then thermally excited using a heat sensitometer within a temperature range 100° to 140° C. for 15 to 60 secs. The optical densities were measured using a transmission densitometer and plotted against the temperature scale.

The temperature required to give a reduction of one half in the difference in absorbance between the coating heated to ~100° C. and the bleached level of ~140° C. is recorded. The coatings were heated for 30 seconds or as indicated.

| Dye No. | Heating time (secs.) | Temperature °C. (±2°) | Optical density ~100° C. | Optical density ~140° C. |
|---|---|---|---|---|
| O-4 | 15 | 122 | 0.22 | 0.14 |
| O-4 | 30 | 126 | 0.22 | 0.10 |
| O-4 | 60 | 126 | 0.18(1) | 0.10 |
| P-1 | 30 | 118 | 0.65 | 0.20 |
| P-4 | 30 | 122 | 0.49 | 0.21 |

(1)This shows a decrease from 0.22 since prolonged heating at 100° C. gradually causes bleaching.

EXAMPLE 4

Bleach reaction in coated layer using mono and disubstituted arylsydnones with a magenta oxonol dye under photochemical excitation Coating formula:

| | |
|---|---|
| methyl ethyl ketone (MEK) | 70 ml |
| Dye solution (P-1) (0.8% w/v EtOH:MEK 3:2) | 30 ml |
| polyethylene glycol (molecular weight 1500) | 4 g |
| sydnone | 3 g |
| polyvinyl butyral (Butvar B-76, Monsanto) | 10 g |

The coating was applied with a knife-coater, at 125 μm wet thickness on a polyester base. The coatings were dried at room temperature under yellow safelights.

The coatings were exposed to UV light (metal halide lamp) through a contact photographic step wedge 0 to 2 log E at 0.15 log E increments. The exposure time was 225 seconds at 70 cm distance. The number of steps bleached, S, as defined in Example 2 were recorded and are reported in the following Table.

| Sydnone | No. of steps bleached |
|---|---|
| S-2 | 7 |
| S-3 | 9 |
| S-4 | 8 |

EXAMPLE 5

Bleach reaction in a coated layer using mono- and disubstituted arylsydnones with a magenta oxonol dye under thermal excitation Coating formula:

| | |
|---|---|
| methyl ethyl ketone | 70 ml |
| Dye solution (P-1) (0.8% w/v EtOH:MEK 3:2) | 30 ml |
| polyethylene glycol (molecular weight 4000) | 4 g |
| Saran F-310 | 15 g |
| sydnone | 3 g |

The coating was applied using a knife-coater at 125 μm wet thickness, with a top coat of 8% w/v ethyl cellulose ($CH_2Cl_2$:MeOH 1:1). The coatings were dried at room temperature under yellow lights.

The coatings were then thermally excited using a heat sensitometer at a temperature range of 100° to 140° C. (4 C.° increments) for 30 seconds. The temperature at which the dye is bleached to half the absorbance difference is reported in the following Table.

| Sydnone No. | Temperature °C. ± 2° C. |
|---|---|
| S-2 | 135 |
| S-3 | 130 |
| S-4 | 130 |

EXAMPLE 6

Bleach reaction in a coated layer using halo-substituted sydnones with a magenta oxonol dye under photochemical excitation Coating formula:

| | |
|---|---|
| methyl ethyl ketone (MEK) | 70 ml |
| Dye solution (P-1) (0.8% W/V EtOH:MEK 3:2) | 30 ml |
| sydnone S-2 | 3.0 g |
| or sydnone S-3 | 3.3 g |
| or sydnone S-5 | 3.6 g |
| or sydnone S-6 | 4.5 g |
| polyethylene glycol MW 4000 | 5.0 g |
| polyethylene glycol MW 1500 | 2.0 g |
| Butvar B-76. | 15 g |

Topcoat: 8% W/V solution of Butvar in ethanol. The coating was applied with a knife-coater at 125 μm wet thickness on a polyester base. The coatings were dried at room temperature under yellow safelights.

The coatings were exposed to UV light (metal halide lamp) through a contact photographic step wedge 0-2 log E at 0.15 log E increments. The exposure time was 225 seconds at 70 cm distance. The number of steps bleached (as defined in Example 2) are reported in the following Table.

| Sydnone No. | No. of steps bleached |
|---|---|
| S-2 | 2 |
| S-3 | 3 |
| S-5 | 5 |
| S-6 | 4 |

EXAMPLE 7

Bleach reaction in a coated layer using halo-substituted sydnones with a magenta oxonol dye under thermal excitation Coating formula:

| | |
|---|---|
| methyl ethyl ketone (MEK) | 70 ml |
| polyethylene glycol MW 4000 | 7 g |
| sydnone S-2 | 3.0 g |
| or sydnone S-3 | 3.3 g |
| or sydnone S-5 | 3.6 g |
| or sydnone S-6 | 4.5 g |
| Saran F-310 | 20 g |
| Dye solution (P-1) (0.8% W/V EtOH:MEK 3:2) | 40 ml |

Topcoat: 8% W/V ethyl cellulose (EtOH:$CH_2Cl_2$ 1:1) The coating was applied using a knife-coater at 125 μm wet thickness, and the topcoat at 75 μm wet thickness. The coatings were dried at room temperature under yellow lights.

The coatings were then thermally excited using a heat sensitometer at a temperature range of 100° to 140° C. (4° C. increments) for 30 seconds. The temperature at which the dyes bleached to half the absorbance difference are reported in the following Table.

| Sydnone No. | Temperature °C. ± 2° C. |
|---|---|
| S-2 | 122 |
| S-3 | 118 |
| S-5 | 114 |
| S-6 | 126 |

EXAMPLE 8

Bleach rate reaction in coated layer using sydnones containing electron rich and electron poor substituents, with a magenta oxonol dye under photochemical excitation Coating formula:

| | |
|---|---|
| methyl ethyl ketone (MEK) | 70 ml |
| Dye solution (P-1) (0.8% W/V EtOH:MEK 3:2) | 30 ml |
| sydnone S-2 | 3.0 g |
| or sydnone S-7 | 3.5 g |
| or sydnone S-8 | 3.5 g |
| polyethylene glycol MW 4000 | 5.0 g |
| Butvar B-76 | 15 g |

The coating was applied using a knife-coater at 125 μm wet thickness on a polyester base. The coatings were dried at room temperature under yellow safelights.

The coatings were exposed to UV light (metal halide lamp) through a contact photographic step wedge 0–2 log E at 0.15 log E increments. The exposure time was 225 seconds at 70 cm distance. The number of steps bleached (as defined in Example 2) are reported in the following Table.

| Sydnone No. | No. of steps bleached |
|---|---|
| S-2 | 2 |
| S-7 | 4 |
| S-8 | 5 |

EXAMPLE 9

Bleach reaction in a coated layer using sydnones containing electron rich and electron poor substituents, with a magenta oxonol dye under thermal excitation Coating formula:

| | |
|---|---|
| methyl ethyl ketone (MEK) | 70 ml |
| Dye solution (P-1) (0.8% W/V EtOH:MEK 3:2) | 30 ml |
| sydnone S-2 | 3.0 g |
| or sydnone S-7 | 3.5 g |
| or sydnone S-8 | 3.5 g |
| or sydnone S-9 | 3.3 g |
| polyethylene glycol MW 4000 | 7.0 g |
| Saran F-310 | 20 g |

The coating was applied using a knife-coater, at 125 μm wet thickness on a polyester base, with a 8% W/V ($EtOH:CH_2Cl_2$ 1:1) ethyl cellulose topcoat at 75 μm wet thickness.

The coatings were thermally excited using a heat sensitomer at a temperature range of 100° to 140° C. (4° C. increments) for 30 seconds. The temperature at which the dye is bleached to half the absorbance difference is reported in the following Table.

| Sydnone No. | Temperature °C. ± 2° C. |
|---|---|
| S-2 | 122 |
| S-7 | 122 |
| S-8 | 126 |
| S-9 | 130 |

EXAMPLE 10

Bleach reaction in a coated layer using a range of different plasticisers under photochemical excitation Coating formula:

| | |
|---|---|
| methyl ethyl ketone (MEK) | 70 ml |
| Dye solution (P-1) (0.8% W/V EtOH:MEK 3:2) | 30 ml |
| 3-phenylsydnone (S-2) | 3.0 g |
| plasticiser | 4.0 g |
| Butvar B-76 | 15 g |

Topcoat: 8% W/V solution of Butvar in ethanol. The coating was applied using a knife-coater at 125 μm wet thickness and topcoat at 75 μm wet thickness. The coatings were dried at room temperature under yellow safelights.

The coatings were exposed to UV light (metal halide lamp) through a contact photographic step wedge, 0–2 log E at 0.15 log E increments. The exposure time was 225 seconds at 70 cm distance. The number of steps bleached (as defined in Example 2) are reported in the following Table.

| Plasticiser | No. of steps bleached |
|---|---|
| polyethylene glycol MW 1000 | 5 |
| polyethylene glycol MW 1500 | 5 |
| polyethylene glycol MW 2000 | 5 |
| polyethylene glycol MW 4000 | 3 |
| polyethylene glycol MW 6000 | 3 |
| polyethylene glycol MW 10000 | 3 |
| polyethylene glycols 1000:4000 (2:3) | 5 |
| suberic acid | 1 |
| acetamide | 1 |
| none | 0 |
| none (exposed for 375 sec) | 1 |

EXAMPLE 11

Bleach reaction in a coated layer using a range of solvent soluble binders under photochemical excitation Coating formula:

| | |
|---|---|
| methyl ethyl ketone (MEK) | 70 ml |
| Dye solution (P-1) (0.8% W/V EtOH:MEK 3:2) | 30 ml |
| 3-phenylsydnone (S-2) | 3 g |
| polyethylene glycol MW 40000 | 4 g |
| binder | 10 g |

The coating was applied using a knife-coater at 125 μm wet thickness, and dried at room temperature under yellow safelights. The coatings were then exposed to UV light (metal halide lamp) through a contact photographic step wedge 0–2 log E at 0.15 log E increments. The exposure time was 225 seconds at a distance of 70 cm. The number of steps bleached (as defined in Example 2) are reported in the following Table.

| Binder | No. of steps bleached |
|---|---|
| Butvar B-76 | 4 |
| Saran F-310 | 1 |
| ethyl cellulose | 4 |
| vinyl acetate (33% w/v in MeOH) | 4 |
| Butvar B-76:ethyl cellulose (1:1 w/w) | 4 |
| Butvar B-76:Saran F-310 (1:1 w/w) | 1 |

EXAMPLE 12

Bleach reaction in a coated layer using a range of water-soluble binders under photochemical excitation Coating formula:

| | |
|---|---|
| MeOH | 70 ml |
| Dye solution (0-4) (0.8% W/V EtOH) | 30 ml |
| 3-(3'-pyridyl)sydnone (S-1) adjust pH to 4 using HCl | 3 g |
| polyethylene glycol MW 4000 | 5 g |
| solution of binder | 20 g |

The formulation was hand coated using K-bar No. 6 and dried in an oven at 60° C. for 15 minutes. The element was exposed to UV light (metal halide lamp) through a contact photographic step wedge, 0–2 log E at 0.15 log E increments. The number of steps bleached (as defined in Example 2 are reported in the following Table. The exposure time was 225 seconds at 70 cm distance.

| Binder (in aqueous solution) | No. of steps bleached |
|---|---|
| polyvinyl alcohol (10% W/V) (POVAL PVA-420, Kuraray Co. Ltd.) | 1 |
| polyvinyl pyrrolidone (20% W/V) | 3 |
| methyl cellulose (5% W/V) | 4 |

EXAMPLE 13

Bleach reaction in a coated layer using gelatin as a binder under photochemical excitation Coating formula:

| | |
|---|---|
| pigskin gelatin (10% w/v aqueous at pH 4) | 70 ml |
| Dye solution (0–4) (0.8% W/V EtOH:$H_2O$ 1:1) | 10 ml |
| Teepol | 0.1 ml |
| 3-(3'-pyridyl)sydnone (S-1) | 4 g |
| polyethylene glycol MW 4000 | 5 g |
| polyethylene glycol MW 1000 | 2 g |
| formaldehyde solution (4%) | 10 ml |
| make up to 100 ml | |

The formulation was coated at 50 μm wet thickness on a polyester base and topcoated with a 4% W/V gelatin solution. The element was exposed to 5 kW UV light (metal halide lamp) at a distance of 70 cm through a contact photographic step wedge as before, for approximately 6 to 12 seconds. The number of steps bleached (as defined in Example 2) was 4.

EXAMPLE 14

A direct proofing system for white light handleable graphic arts film

White light handleable graphic arts copy films which use very fine grained silver halide emulsions, sensitive to light about 400 nm, require a direct proofing imaging system which would record and display the exposed image before the processing step, in order to help the user in any montage type work. Such an image should be removed or destroyed during the subsequent conventional processing steps of the silver halide, leaving a final dye free silver image.

This Example illustrates a composition which can be coated in close proximity to the light sensitive silver halide layer (i.e. as a top or underlayer or as a backing to the transparent film base) and because of the nature of the chemistry involved (oxonol dye, sydnone, etc.). The dye image is destroyed completely in the developing bath.

To a fine grained white light contact graphic arts film, the formulation of Example 13 was coated as a backing to the polyester film base at 50 μm wet thickness. UV exposure (metal halide light source: 6 to 12 seconds) through a positive transparency, produced a bleached image on a blue coloured background. Processing the film through a conventional silver halide graphic arts developer produced a dye free silver image of the master.

We claim:

1. A composition capable of bleaching upon exposure to radiation of selected wavelength within the range 200 to 1100 nm and/or upon heating to at least 70° C., said composition comprising a bleachable dye in reactive association with a mesoionic bleaching compound wherein said mesoionic compound contains a five- or six-membered heterocycle which cannot be represented satisfactorily by any one covalent or polar structure and possesses a sextet of electrons in association with all the atoms comprising the ring.

2. A composition as claimed in claim 1, in which the weight ratio of mesoionic compound:bleachable dye is at least 4:1.

3. A composition as claimed in claim 1, in which the bleachable dye has the general formula:

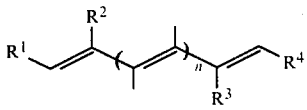

in which:

n is an integer of 1 to 5, $R^1$ to $R^4$ are selected to provide an electron donor moiety at one end of the conjugated chain and an electron acceptor moiety at the other, and represent alkyl, aryl groups or heterocyclic rings any of which may be substituted, said group generally containing up to 14 atoms selected from C, N, O and S; or $R^1$ and $r^2$ and/or $R^3$ and $R^4$ may represent the necessary atoms to complete optionally substituted aryl groups or heterocyclic rings, generally containing up to 14 atoms selected from C, N, O and S.

4. A composition as claimed in claim 2, in which the bleachable dye has the general formula:

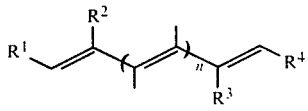

in which:

n is an integer of 1 to 5, $R^1$ to $R^4$ are selected to provide an electron donor moiety at one end of the conjugated chain and an electron acceptor moiety at the other, and represent alkyl, aryl groups or heterocyclic rings any of which may be substituted, said group generally containing up to 14 atoms selected from C, N, O and S; or $R^1$ and $R^2$ and/or $R^3$ and $R^4$ may represent the necessary atoms to complete optionally substituted aryl groups or heterocyclic rings, generally containing up to 14 atoms selected from C, N, O and S.

5. A composition as claimed in claim 3, in which the bleachable dye is a cyanine, merocyanine or oxonol dye.

6. A composition as claimed in claim 4, in which the bleachable dye is a cyanine, merocyanine or oxonol dye.

7. A composition as claimed in claim 1 in which the mesoionic compound has the general formula:

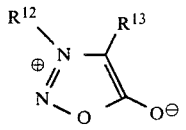

in which:

$R^{12}$ represents an alkyl or aryl group or a heterocyclic ring, any of which groups may be substituted, and $R^{13}$ represents an alkyl or aryl group either of which may be substituted, a hydrogen atom, an amino or an alkoxy group.

8. A composition as claimed in claim 4, in which the mesoionic compound has the general formula:

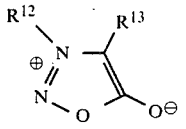

in which:

$R^{12}$ represents an alkyl or aryl group or a heterocyclic ring, any of which groups may be substituted, and $R^{13}$ represents an alkyl or aryl group either of which may be substituted, a hydrogen atom, an amino or an alkoxy group.

9. A composition as claimed in claim 6, in which the mesoionic compound has the general formula:

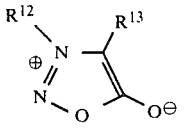

in which:

$R^{12}$ represents an alkyl or aryl group or a heterocyclic ring, any of which groups may be substituted, and $R^{13}$ represents an alkyl or aryl group either of which may be substituted, a hydrogen atom, an amino or an alkoxy group.

10. A composition as claimed in claim 1, in which the mesoionic compound is a sydnone of the general formula:

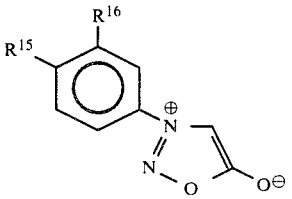

in which:

$R^{15}$ and $R^{16}$ independently represent a hydrogen or halogen atom, an alkyl or alkoxy group, CN or OH.

11. A composition as claimed in claim 2, in which the mesoionic compound is a sydnone of the general formula:

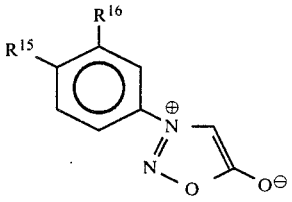

in which:

$r^{15}$ and $R^{16}$ independently represent a hydrogen or halogen atom, an alkyl or alkoxy group, CN or OH.

12. A composition as claimed in claim 4, in which the mesoionic compound is a sydnone of the general formula:

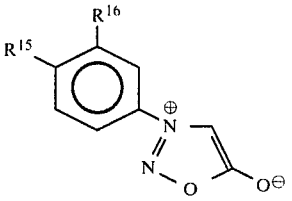

in which:

$R^{15}$ and $R^{16}$ independently represent a hydrogen or halogen atom, an alkyl or alkoxy group, CN or OH.

13. A composition as claimed in claim 5, in which the mesoionic compound is a sydnone of the general formula:

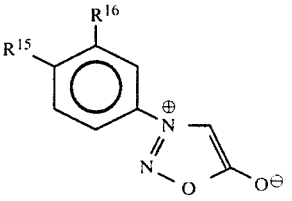

in which:

$R^{15}$ and $R^{16}$ independently represent a hydrogen or halogen atom, an alkyl or alkoxy group, CN or OH.

14. A composition as claimed in claim 6, in which the mesoionic compound is a sydnone of the general formula:

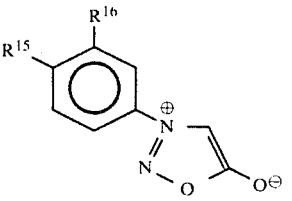

in which:

$R^{15}$ and $R^{16}$ independently represent a hydrogen or halogen atom, an alkyl or alkoxy group, CN or OH.

15. A composition as claimed in claim 1, in which the dye and mesoionic compound are dissolved in a solvent.

16. A composition as claimed in claim 2, which additionally comprises a binder and optionally a solvent.

17. A composition as claimed in claim 16, suitable for forming a radiation sensitive coating on a support comprising:

0.01 to 1.0% by weight of dye,
0.04 to 10% by weight of mesoionic compound,
0.5 to 25% by weight of binder,
to 100% solvent (w/v).

18. A composition as claimed in claim 17, suitable for forming a radiation sensitive coating on a support comprising:

0.8 to 0.4% by weight of dye,
3 to 4.5% by weight of mesoionic compound,
1 to 20% by weight of binder,
to 100% solvent (w/v).

19. A composition as claimed in claim 16, which additionally comprises a plasticizer in an amount of 10% by weight.

20. A composition as claimed in claim 19, in which the plasticizer is selected from glycerol, sorbitol, polyglycols, polyethylene glycols and esters thereof, and any mixtures thereof.

21. An element capable of recording a positive image upon imagewise exposure to radiation within the wavelength range of 200 to 1100 nm or upon heating to a temperature of at least 70° C., comprising a support having on at least one surface thereof a bleachable dye in reactive association with a mesoionic bleaching compound wherein said mesoionic compound contains a five- or six-membered heterocycle which cannot be represented satisfactorily by any one covalent or polar structure and possesses a sextet of electrons in association with all the atoms comprising the ring.

22. An element capable of recording a positive image upon imagewise exposure to radiation within the wavelength range of 200 to 1100 nm or upon heating to a temperature of at least 70° C., comprising a support having on at least one surface thereof a bleachable dye in reactive association with a mesoionic bleaching compound in which the bleachable dye has the general formula:

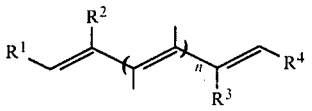

in which:

n is an integer of 1 to 5, $R^1$ to $R^4$ are selected to provide an electron donor moiety at one end of the conjugated chain and an electron acceptor moiety at the other, and represent alkyl, aryl groups or heterocyclic rings any of which may be substituted, said group generally containing up to 14 atoms selected from C, N, O and S; or $R^1$ and $R^2$ and/or $R^3$ and $R^4$ may represent the necessary atoms to complete optionally substituted aryl groups or heterocyclic rings, generally containing up to 14 atoms selected from C, N, O and S.

23. A recording element comprising a support, one or more radiation sensitive layers and as an antihalation layer, a layer containing a bleachable dye in reactive association with a mesoionic bleaching compound wherein said mesoionic compound contains a five: or six-membered heterocycle which cannot be represented satisfactorily by any one covalent or polar structure and possesses a sextet of electrons in association with all the atoms comprising the ring.

24. A method of recording a positive image comprising imagewise exposing the element of claim 21 to a heat source of at least 70° C. or radiation having a wavelength at the maximum absorbance of the mesoionic compound.

25. A method of bleaching an antihalation layer of the element of claim 23 which comprises irradiating said antihalation layer with radiation having a wavelength of the maximum absorbance of the mesoionic compound or heating said layer to a temperature of at least 70° C.

* * * * *